US009483918B2

(12) United States Patent
Uriarte

(10) Patent No.: US 9,483,918 B2
(45) Date of Patent: Nov. 1, 2016

(54) PERSONAL ILLUMINATION DEVICE WITH VARIABLE LIGHTING PATTERNS

(71) Applicant: Marcos Uriarte, Matawan, NJ (US)

(72) Inventor: Marcos Uriarte, Matawan, NJ (US)

( * ) Notice: Subject to any disclaimer, the term of this patent is extended or adjusted under 35 U.S.C. 154(b) by 48 days.

(21) Appl. No.: 14/522,690

(22) Filed: Oct. 24, 2014

(65) Prior Publication Data

US 2015/0116988 A1 Apr. 30, 2015

Related U.S. Application Data

(60) Provisional application No. 61/894,939, filed on Oct. 24, 2013.

(51) Int. Cl.

| | |
|---|---|
| ***F21V 21/108*** | (2006.01) |
| ***G08B 5/00*** | (2006.01) |
| ***A41D 13/01*** | (2006.01) |

(52) U.S. Cl.

CPC ..... *G08B 5/004* (2013.01); *A41D 13/01* (2013.01)

(58) Field of Classification Search

CPC .... A41D 13/01; F21L 4/027; F21V 21/0885; F21V 21/08; F21Y 2101/02; F21W 2121/06; G08B 5/004

See application file for complete search history.

(56) References Cited

U.S. PATENT DOCUMENTS

| | | | |
|---|---|---|---|
| 1,717,386 | A | 6/1929 | Kaplan |
| 2,275,765 | A | 3/1942 | Hummert et al. |
| 2,506,685 | A | 5/1950 | Sadloski et al. |
| 2,555,871 | A | 6/1951 | Caggiano |
| 2,710,338 | A | 6/1955 | Svalgaard |
| 3,665,451 | A | 5/1972 | Keith |
| 3,731,084 | A | 5/1973 | Trevorrow |
| 3,947,676 | A | 3/1976 | Battilana et al. |
| 4,298,913 | A | 11/1981 | Lozar |
| 4,328,533 | A | 5/1982 | Paredes |
| 4,849,863 | A | 7/1989 | Gallegos |
| 4,984,724 | A | 1/1991 | Johnston |
| 5,063,483 | A | 11/1991 | Feilmeier et al. |
| 5,070,436 | A | 12/1991 | Alexander et al. |
| 5,193,896 | A | 3/1993 | Oberlander |
| 5,304,035 | A | 4/1994 | Carter |
| 5,359,501 | A | 10/1994 | Stevens |
| 5,381,318 | A | 1/1995 | Fang |
| 5,412,545 | A | 5/1995 | Rising |
| 5,779,348 | A | 7/1998 | Interlicchio |
| 6,095,657 | A | 8/2000 | Kent |
| 6,106,130 | A | 8/2000 | Harding |
| 6,109,761 | A | 8/2000 | Smith et al. |
| 6,267,482 | B1 | 7/2001 | Miller et al. |
| 6,315,426 | B1 | 11/2001 | Buller, Jr. |
| 6,461,015 | B1 | 10/2002 | Welch |
| 6,554,445 | B1 | 4/2003 | Jacoby |

(Continued)

*Primary Examiner* — Andrew Coughlin
*Assistant Examiner* — Meghan Ulanday
(74) *Attorney, Agent, or Firm* — Gearhart Law LLC

(57) ABSTRACT

A personal illumination device is described and taught. The personal illumination device is intended for use by motorcyclists, however, it may be used by any number of individuals looking to increase their visibility in environments where high visibility and safety is paramount. The illumination device has two illuminated strips that sit across the front and back of a user. The strips have LEDs positioned across capable of creating various illuminate patterns. Additionally, a user can choose to have either the front, back, or both strips illuminated at the same time. The personal illumination device further has straps that provide for adjustments to create a custom fit, as well as enhancement strips placed on the straps to further increase one's visibility.

13 Claims, 5 Drawing Sheets

(56) References Cited

U.S. PATENT DOCUMENTS

| | | | |
|---|---|---|---|
| 6,991,343 | B2 | 1/2006 | Langley et al. |
| 7,175,295 | B2 | 2/2007 | Bretz et al. |
| 7,195,369 | B2 | 3/2007 | Shaw |
| 7,377,665 | B2 | 5/2008 | Langenwalter |
| 7,828,455 | B2 | 11/2010 | Barker |
| 8,210,704 | B1 | 7/2012 | Parsons |
| 8,408,731 | B1 | 4/2013 | Joyner |
| 8,449,133 | B2 | 5/2013 | Winzer et al. |
| 2003/0161139 | A1 | 8/2003 | Putallaz |
| 2004/0184262 | A1 | 9/2004 | De Silva |
| 2005/0225964 | A1 | 10/2005 | Simoni |
| 2005/0254229 | A1 | 11/2005 | Hamade et al. |
| 2005/0276036 | A1 | 12/2005 | Miles et al. |
| 2006/0176681 | A1 | 8/2006 | Krimmer |
| 2007/0053179 | A1 | 3/2007 | Pang et al. |
| 2007/0177376 | A1 | 8/2007 | Simoni |
| 2009/0122526 | A1 | 5/2009 | Lei |
| 2009/0129064 | A1 | 5/2009 | Zeller |
| 2010/0124049 | A1 | 5/2010 | Fabian |
| 2011/0038142 | A1 | 2/2011 | Ritter et al. |
| 2012/0193986 | A1 | 8/2012 | Easwaran et al. |

PERSONAL ILLUMINATION DEVICE WITH VARIABLE LIGHTING PATTERNS

CLAIM OF PRIORITY

This application claims priority to U.S. Application Ser. No. 61/894,939 filed on Oct. 24, 2013, the contents of which are incorporated herein by reference in their entirety.

FIELD OF THE INVENTION

The field of the invention relates to personal safety and illumination devices, namely devices that are worn and make a user more visible under inclement conditions. In particular, the field relates to a wearable device for motorcyclists that increases their visibility on the road by way of variable lighting patterns.

BACKGROUND OF THE INVENTION

Motorcycles are one of the most affordable forms of transportation available in today's society. There are motorcycles available on the market that will get a rider as many as 80 miles per gallon (mpg) or more and cost around USD $3000-$3500. Most motorcyclists, worldwide, are abroad in developing countries or countries with high population densities such as China and India. However, motorcyclists are still present domestically, and a commonplace in many parts of the country. One drawback to riding motorcycles is the associated risk of being on the open road with no external structure to protect the rider.

In 2006, according to the U.S. National Highway Traffic Safety Administration (NHTSA), 13.10 cars per every 100,000 registered automobiles were involved in fatal accidents. For motorcycles, the rate was 72.34 per 100,000 registered motorcycles. Thus, motorcycle riders were over five and a half times (5.5×) more likely to be involved in a fatal accident while on the road. One of the most comprehensive motorcycle accident studies to date, the Hurt Report, found that about seventy five percent (75%) of motorcycle accidents involved a passenger car. Additionally it was found that in multiple vehicle accidents, the other driver violated the motorcyclist's right of way about sixty six percent (66%) of the time. The report ultimately concluded that motorists failing to notice or detect motorcyclists is the predominate cause of accidents involving motorcycles. However, it was noted that head lamps and wearing high visibility colors such as red, yellow, and orange helped to mitigate motorcycle accident involvement.

Reviewing of related technology:

U.S. Pat. No. 7,377,665 teaches a belt buckle with an embedded power source, such as a battery, and an attached or embedded light source, such as light emitting diodes, for illuminating an area in front of a user, such as a hiker, climber, or trail-runner. The buckle is typically a side-release plastic buckle, and is typically mounted centrally on a pack's hip-belt. The light is adjustable vertically, or has a lens to produce a tall, narrow beam of light for the purpose of illuminating a large section of trail.

U.S. Pat. No. 6,095,657 teaches a flashlight assembly that has a body with spaced end portions each attachable to one of two shoulder straps so that the body may be suspended across the chest of a user with its end portions level. The body includes a battery compartment and a switch, and each end portion has lugs pivotally mounting a lamp, each lamp including a reflector and a light source connectable to a battery in the compartment via the switch. The lamps are independently pivotal through at least a right angle about a horizontal axis such that with the body held in position across the user's chest, the lamps may be adjusted so that one provides a light beam capable of illuminating the ground near the user's feet while the other illuminates objects in front of the user, or alternatively so that both lamps may illuminate objects in front of the user.

U.S. Patent Application 2011/0038142 teaches illumination gear that has a strap pad slidably mounted on a strap. A battery-operated lamp is mounted on the strap pad. The strap pad with lamp may be adjusted anywhere along the strap, so as to adjust the position of the lamp to a desired height. The illumination gear may be constructed as a harness, as a vest, or as a set of suspenders. Anchor straps may be provided on the vest or the harness, to secure the straps to belt loops on a trouser waistband or to another garment, to prevent the illumination gear from riding up or shifting position.

Thus, it is desirable to have an invention, such as that in the present disclosure, that combines the use of high intensity light and color to produce an efficient, wearable safety device for motorcyclists. Various devices are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE INVENTION

A personal illumination device is described and taught having a first illumination strip with a first outer surface and a first inner surface, the first outer surface having an embedded light source; a second illumination strip having a second outer surface and a second inner surface, the second outer surface having an embedded light source; at least one shoulder strap having a first end and a second end, wherein the first end is coupled to the first illumination strip and the second end is coupled to the second illumination strip; at least one waist strap coupled to the second illumination strip, the at least one waist strap having a terminal end with a clip attached thereto; and a complimentary clip disposed on the first inner surface of the first illumination strip, the complimentary clip being complimentary in shape to the clip attached to the at least one waist strap.

Ideally, the personal illumination device has two shoulder straps and two waist straps. However, the number of straps, their configuration, and means of attachment may vary depending on the intended use. The shoulder straps should be allowed to rest over the shoulders with one illumination strip positioned laterally on each side of the user's body. The waist straps can then be brought forward and clipped into place thereby securing the device to the user. The embedded light source is preferably a number of light emitting diodes (LEDs). The LEDs can be turned on or off by a depressible button located on the first illumination strip. Additionally, the LEDs may strobe, flash, or otherwise create patterns designed to draw attention to the LEDs and subsequently making the user more visible. Further, the illumination device has a power source which may be located internally.

In an alternate embodiment there is a personal illumination device having a first illumination strip having a first outer surface and a first inner surface, the first outer surface having a plurality of light emitting diodes disposed thereon; a second illumination strip having a second outer surface and a second inner surface, the second outer surface having a plurality of light emitting diodes disposed thereon; a plurality of depressible buttons embedded on the first outer surface of the first illumination strip; two shoulder straps each having a first end and a second end, wherein the first end is coupled to the first illumination strip and the second end is coupled to the second illumination strip with each of the two shoulder straps having an enhancement strip disposed on a visible surface; two waist straps coupled to the second illumination strip, the two waist straps each having a terminal end with a singular clip attached thereto and each of the two waist straps having an enhancement strip on a visible surface; an integrated complimentary clip on the first inner surface of the first illumination strip, the integrated complimentary clip being complimentary in shape to the singular clip attached to the two waist straps; and a power source operably connected to the plurality of light emitting diodes.

The personal illumination device further has strap adjustment mechanisms. These mechanisms are ideally located on each of the two shoulder straps and each of the two waist straps. These mechanisms permit the length of each of the shoulder straps and each of the waist straps to be independently adjusted providing maximum comfort and a proper fit. In order to provide for these strap adjustment mechanisms, at least one of the ends of each of the straps is coupled with a looped fastener. The looped fastener enables the respective strap to be pulled through and looped back pulling the end through and securing it with the strap adjustment mechanism. Each of the visible surfaces of the strap have enhancement strips. These strips help to increase visibility in the event the lights, or LEDs, are turned off or to work in conjunction with the LEDs. The personal illumination device is powered by at least one rechargeable or dry cell battery.

In general, the present invention succeeds in conferring the following, and others not mentioned, benefits and objectives.

It is an object of the present invention to provide a personal illumination device that increases the visibility of the user.

It is an object of the present invention to provide a personal illumination device that uses high intensity lighting to increase the visibility of the user.

It is an object of the present invention to provide a personal illumination device that uses retroreflective surfaces and bright colors to increase the visibility of the user.

It is an object of the present invention to provide a personal illumination device that has variable lighting patterns.

It is an object of the present invention to provide a personal illumination device that can be worn and increase user visibility in daylight or at night.

It is another object of the present invention to provide a personal illumination device that can be worn by motorcyclists.

It is an object of the present invention to provide a personal illumination device that is designed specifically for use by motorcyclists.

DETAILED DESCRIPTION OF THE INVENTION

Figure 1:
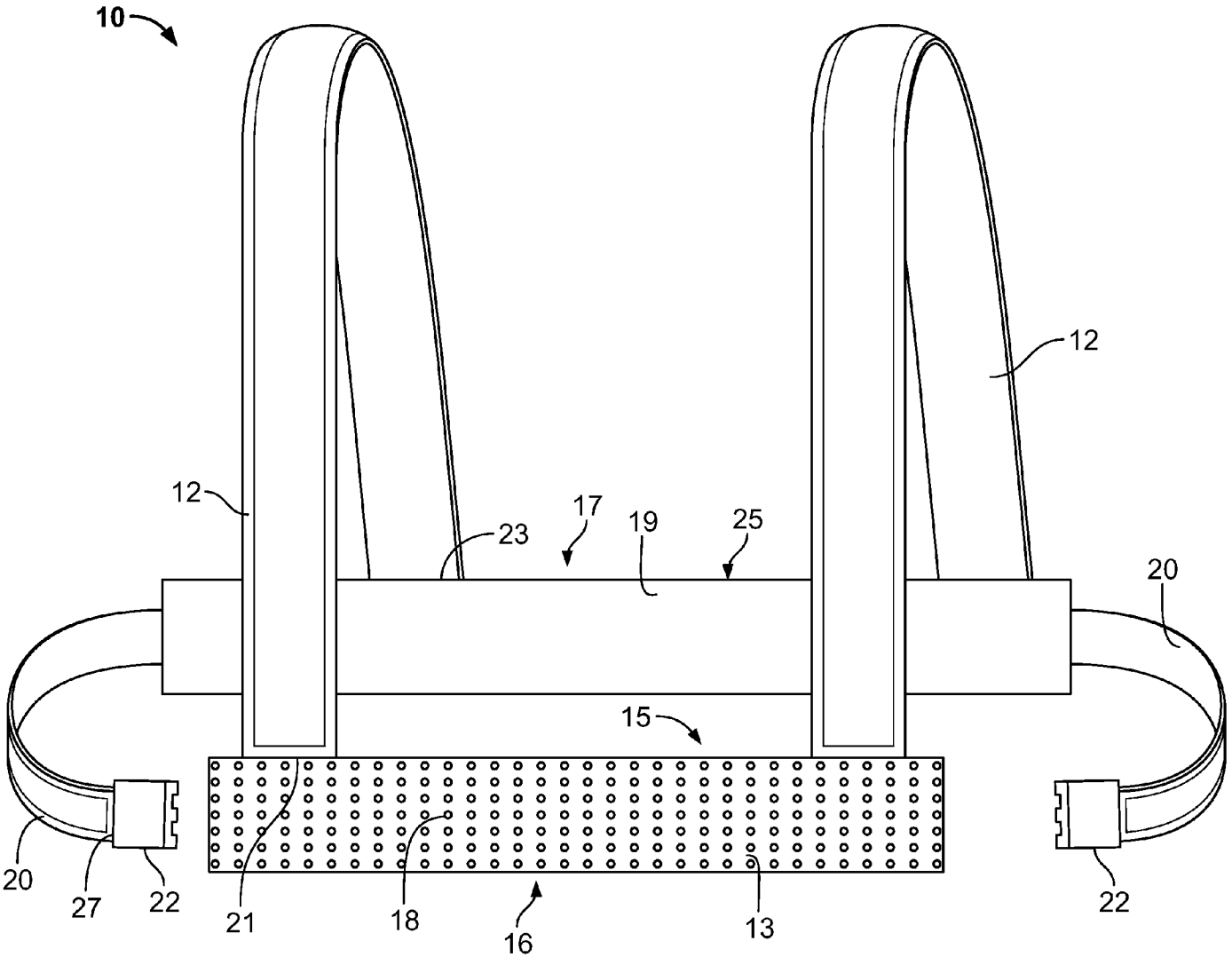
FIG. 1 is a perspective view of a first embodiment of the present invention.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Referring to the drawings, FIG. 1 illustrates a first embodiment of the present invention. The personal illumination device 10 has a first illumination strip 16 and a second illumination strip 17. Upon an outer surface 13 of the first illumination strip 16 and an outer surface 25 of the second illumination strip 17, there are embedded light sources in the form of light emitting diodes (LEDs) 18. There are at least one, and ideally two, shoulder straps 12 that are coupled to the illumination strips 16, 17. Each of the shoulder straps 12 have a first end 21 and a second end 23 attached respectively to the first and second illumination strips 16, 17. There are at least one, and ideally two, waist straps 20 that are permanently affixed to the second illumination strip 17. Each of the waist straps 20 are substantially alike and have a terminal end 27 with a clip 22 attached. The clip 22 has a number of grooves 36 and a depressible member 34 (see FIG. 3A). The clip 22 locks into a complimentary clip 40 on the inner surface 15 of the first illumination strip 16 (see FIG. 3B). To wear the illumination device 10, a user places their head through the area between the shoulder straps 12 and allows the shoulder straps 12 to rest comfortably on their shoulders. The waist straps 20 are brought forward, one at a time, and the clip 22 is secured with the complimentary clip 40. This four point strap system ensures the illumination device 10 is secured to the user and worn properly to promote maximum safety assurances.

Figure 2:
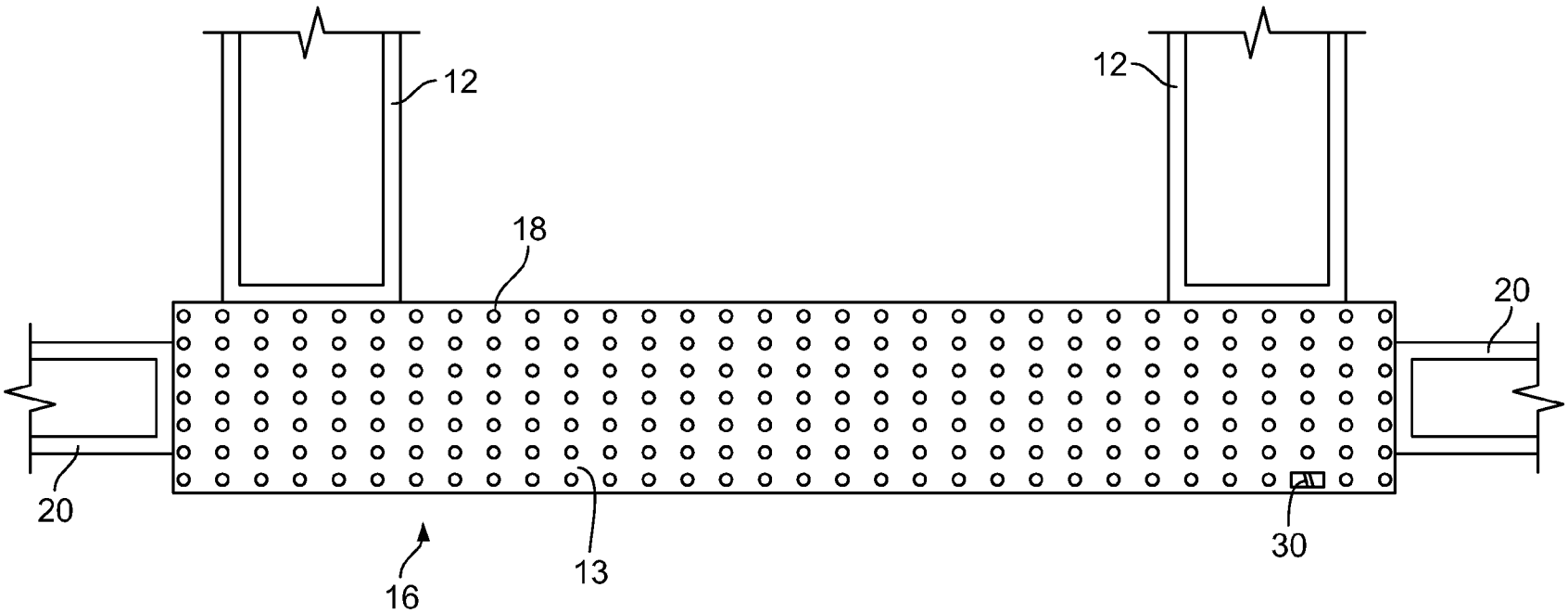
FIG. 2 is a detailed side view of a first illumination strip.

FIG. 2 is a close up view of the first illumination strip 16 with the shoulder straps 12 and waist straps 20 attached. The first illumination strip 16 and second illumination strip 17 are substantially similar and by describing one of the strips the same descriptors can be applied to the other unless otherwise noted. The illumination strip 16 is preferably about 24 cm (9.5 inches) in length and about 5 cm (2 inches) in width. However, the illumination strip 16 may range from about 13 cm (5 inches) to about 61 cm (24 inches) in length and about 1.3 cm (0.5 inches) to about 20 cm (8 inches) in width. Across the outer surface 13 there are a number of LEDs 18. The LEDs 18 are ideally uniformly dispersed across the illumination strip 16. The number of LEDs 18 can vary wildly based on the size, spacing, and desired capabilities of the illumination device 10. Preferably the LEDs 18 are yellow in color and range in wavelength from about 570 nm to about 590 nm. Traditional semiconductors for yellow LEDs 18 should be used such as gallium arsenide phosphide, aluminum gallium indium phosphide, and gallium (III) phosphide. Other colors may be used such as orange or green. However, it may be wise to avoid certain colors (i.e. red and blues) and other light colors and patterns that may mimic emergency vehicles. In addition, it may be preferable in some cases to employ organic light emitting diodes (OLEDs).

At opposing end of the illumination strip 16 there is at least one depressible button such as an on/off button 30. Further depressible buttons may include a selection indicator that can cause the illumination device 10 to light up the first illumination strip 16 only, the second illumination strip 17 only or both concurrently. The on/off button 30 turns the LEDs 18 present on the illumination device 10 on or off. If a user depresses the on/off button 30 once, the LEDs 18 will be brought to the opposing state (i.e. LEDs are off, press button, LEDs light up). Additionally, in some cases, there is a strobe button (not shown) that controls the variable patterns emitted by the LEDs 18. The number and type of lighting patterns may vary. Additionally, the user may be able to design and upload lighting patterns to the device 10. Examples of lighting patterns may be intermittent strobing, synchronized flashing, back and forth "movement," up and down "movement," or synchronized flashing/strobing between the first illumination strip 16 and second illumination strip 17. The depressible button 30 may also have other configurations such as selection indicators. For example, the buttons would have a slide indicator that would open, close, or otherwise change the state of the circuit. This switch could be toggled between various settings to create the desired lighting effect or lack thereof. Whichever button configuration the illumination device 10 possesses, there should be independent buttons for each of the illumination strips 16, 17.

Figure 3A:
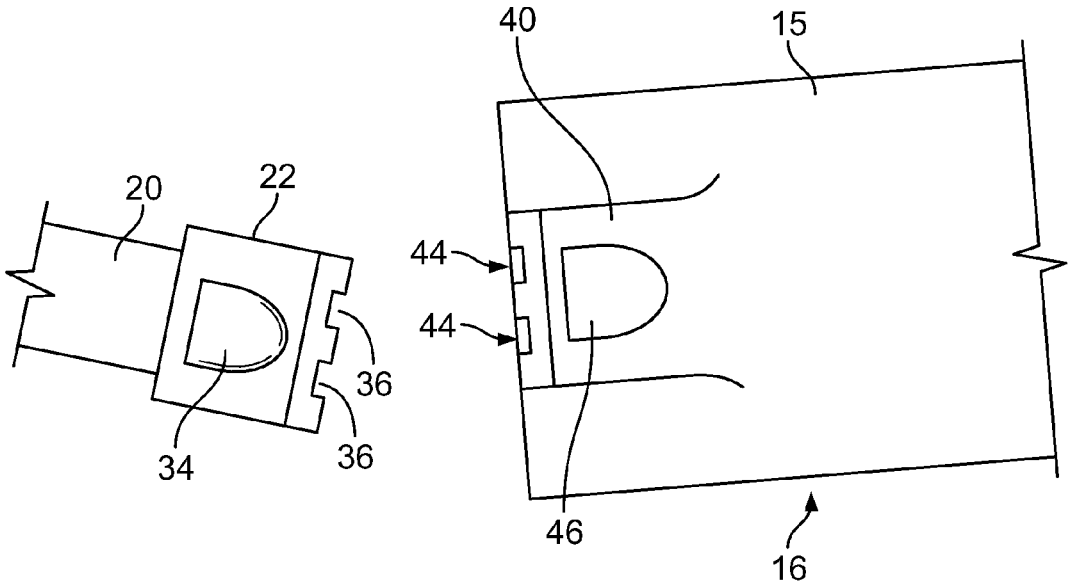
FIG. 3A is a perspective view of the clip and complimentary clip as separate entities.
Figure 3B:
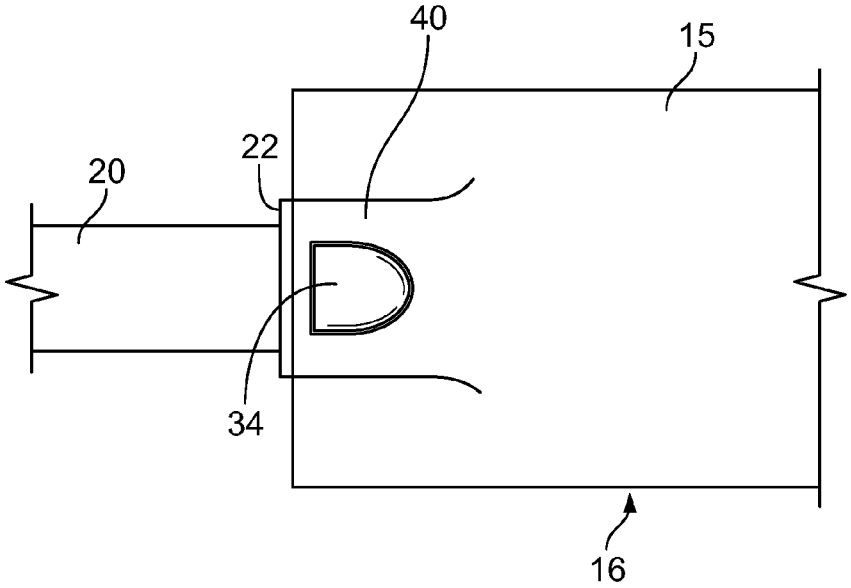
FIG. 3B is a side view of the clip and complimentary clip joined.

In FIGS. 3A and 3B a close up of the interaction between the clip 22 and complimentary clip 40 is shown. The clip 22 is coupled to the terminal end 27 of one of the waist straps 20. The clip 22 has a number of grooves 36 and a depressible member 34. The complimentary clip 40 can be attached to or integrated to the inner surface 15 of the illumination strip 16. Ideally, the end of the complimentary clip 40 opposite the connecting area is tapered as to provide comfort and prevent snagging of clothing or other items. The complimentary clip 40 has complimentary grooves 44 and a complimentary void 46 that mirrors that of the depressible member 34. A user would take the clip 22 and slide it into the complimentary clip 40. The clip 22 is guided in until the depressible member 34 pops up and into the complimentary void 46 as shown in FIG. 3B. To release the two clips 22, 40 one must simply press down on the depressible member 34 and remove the clip 22 from the complimentary clip 40. The clip 22 may be replaced in some embodiments with various clips, buckles, latches, or similarly structured coupling mechanism. For example, a latch that uses slidable members that when squeezed together release the latch.

Figure 4:
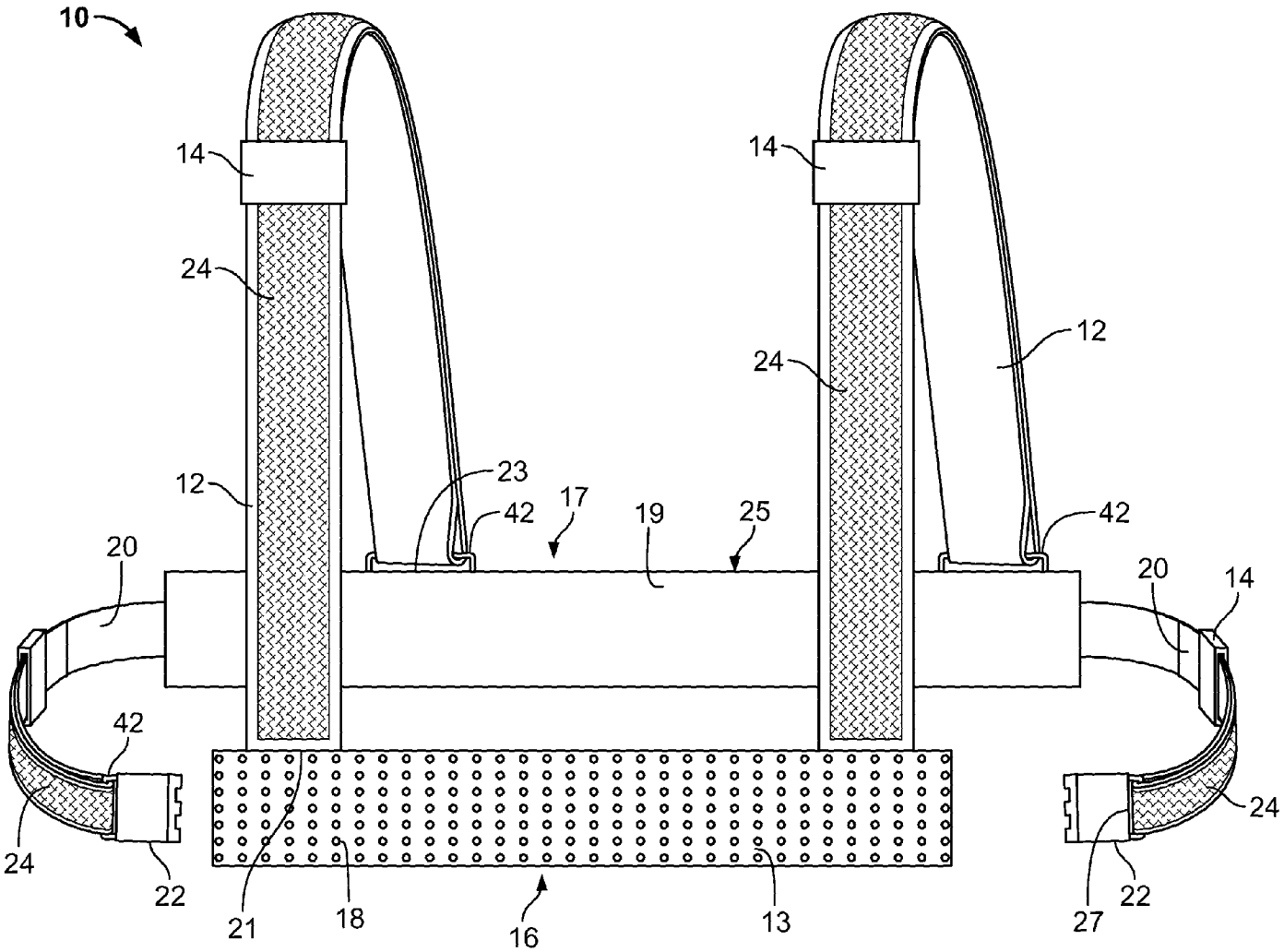
FIG. 4 is a perspective view of a second embodiment of the present invention.

FIG. 4 illustrates a second embodiment of the present invention. The first illumination strip 16 and second illumination strip 17 are coupled by the two shoulder straps 12. The device 10 is further secured by the waist straps 20. On the outer surface 13 of the first illumination strip 16 and the outer surface 25 of the second illumination strip 17 there is a plurality of LEDs 18. The general functionality of the device 10 is substantially similar as described above. Here, the shoulder straps 12 and waist straps 20 have strap adjustment mechanisms 14. These adjustment mechanisms 14 are present to provide greater flexibility in the comfort and fit of the device 10. In order to use the adjustment mechanism(s) 14 the device 10 further has a looped fastener 42. The looped fastener 42 preferably is attached to the first or second illumination strip 16, 17 and the terminal ends 27 of the waist straps 20. The looped fastener 42 has two elevated prongs with a bar extending therebetween. The looped fastener 42 permits an excess length of the shoulder strap 12 or waist strap 20 to be passed under the bar and back up and around. The length of shoulder or waist strap 12, 20 is pulled through the adjustment mechanism 14. The adjustment mechanism 14 has a flattened circular opening that is just wide enough to fit two times the diameter of the shoulder or waist strap 12, 20. This narrow opening allows the adjustment mechanism 14 to secure the strap in place.

The device 10 further has enhancement strips 24 on the visible strap surfaces. The enhancement strips 24 may be lighted, reflective, have high visibility colors, or any combination thereof. The enhancement strips 24 may be adhered to the straps by a mechanical or chemical means. Alternatively, the enhancement strip 24 may be part of the strap itself. Such reflective surfaces may be comprised of retroreflectors. High visibility colors can be colors such a fluorescent red, fluorescent green, and fluorescent yellow, and fluorescent orange. The enhancement strips 24 may also be lighted by LEDs 18 or another lighting source. The enhancement strips 24 may also employ a combination of these high visibility techniques.

Figure 5A:
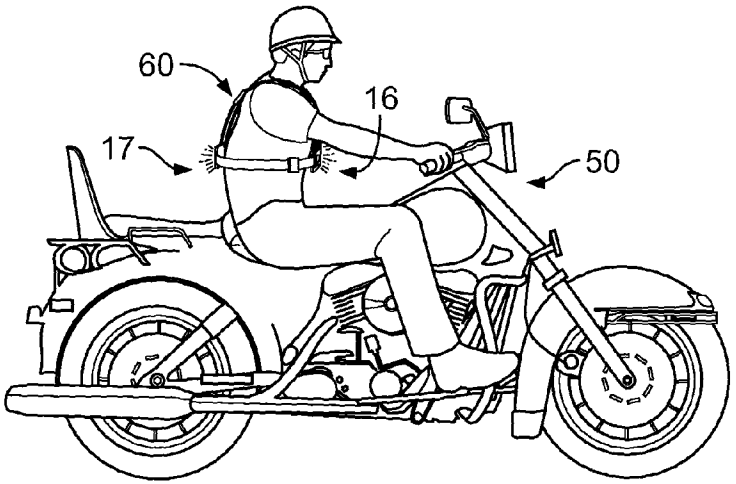
FIG. 5A is a side view of a motorcyclist wearing the present invention as intended.
Figure 5B:
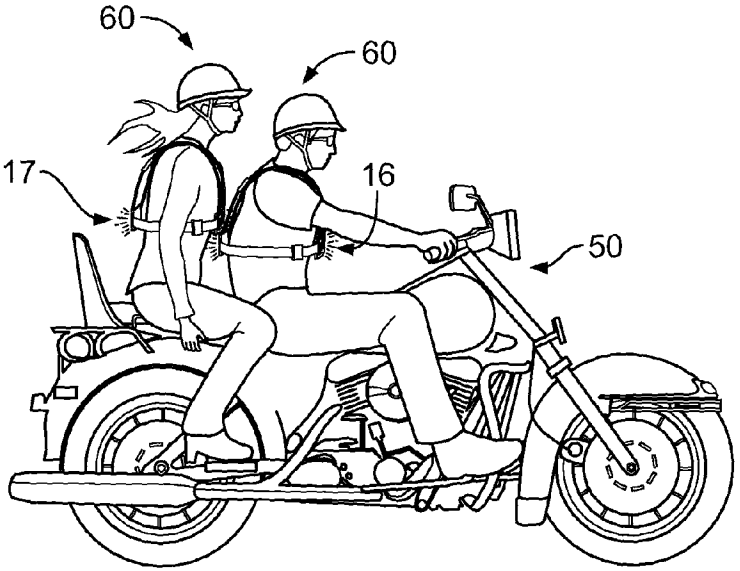
FIG. 5B is a side view of multiple motorcyclists riding together while wearing the present invention as intended.
Figure 5C:
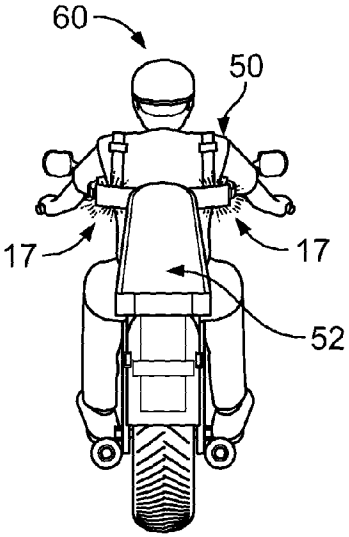
FIG. 5C is a rearview of a motorcycle with the motorcyclists wearing the present invention as intended.

FIGS. 5A-C all show the device 10 as described above and in FIGS. 1-4 worn by a motorcyclist 60 and demonstrating the unique usage and features applicable to motorcycle riding. In FIG. 5A, there is a single motorcyclist 60 riding a motorcycle 50 while wearing the illumination device 10. The shoulder straps 12 leave one of the two illumination strips 16, 17 on each side of the motorcyclist's body. With each of the illumination strips 16, 17 illuminated, the motorcyclist 60 can greatly increase the chances of being seen on the roadways from a multitude of angles. The rear facing and forward facing illumination strips 16, 17 permit oncoming traffic as well as traffic approaching from the rear to clearly identify the motorcyclist 60.

FIG. 5B illustrates two motorcyclists 60 riding on the same motorcycle 50. The unique functionality of the device 10 is evident in this scenario. The device 10 can illuminate either of the illumination strips 16, 17 or both simultaneously. The first illumination strip 16 of the front motorcyclist 60 and the second illumination strip 17 of the rear motorcyclist 60 are illuminated in this Figure. This permits the device 10 to have same effect on increased visibility regardless of the number of riders on a particular motorcycle 50 while conserving power and preventing unwanted/unnecessary lighting.

FIG. 5C demonstrates another unique feature of the device 10 when viewed from the rear (or behind) a motorcycle 60. Here, the illumination device 10 is illuminated and visible from the rear of the motorcycle 60. However, the seat 52 of a motorcycle 60 creates a blockage of a view from the rear of the motorcyclist 50. The illumination strips 16, 17 are of such a length that they remain visible from each side of this blockage. Additionally, the enhancement strips 24 placed along the shoulder straps 12, which run down the back of the motorcyclist, provide further visibility cues.

In general, there are a number of design variables and acceptable materials that could be incorporated in to the illumination device 10. The shoulder straps 12 and waist straps 20 may be a woven fabric such as nylon. In some instances, there may be an elastic element to the straps 12, 20 to improve the fit of the device 10 and to prevent slippage to due body position or forces stemming from external elements. The straps 12, 20 may also be adhered to the illumination strips 16, 17 by differing means and in differing positions. The straps 12, 20 may be adhered using chemicals such as glues, resins, epoxies, and the like. The straps 12, 20 may also be adhered through mechanical stitching.

What is claimed is:

1. A personal illumination device comprising:

a first illumination strip having a first outer surface and a first inner surface, the first outer surface having an embedded light source;

a second illumination strip having a second outer surface and a second inner surface, the second outer surface having an embedded light source;

at least one shoulder strap having a first end and a second end, wherein the first end is coupled to the first illumination strip and the second end is coupled to the second illumination strip;

at least one waist strap coupled to the second illumination strip, the at least one waist strap having a terminal end with a clip attached thereto; and a complimentary clip disposed on the first inner surface of the first illumination strip, the complimentary clip being complimentary in shape to the clip attached to the at least one waist strap.

2. The personal illumination device of claim 1 wherein there are two shoulder straps.

3. The personal illumination device of claim 1 wherein there are two waist straps.

4. The personal illumination device of claim 1 further comprising a power source.

5. The personal illumination device of claim 1 wherein the clip has a plurality of grooves and a depressible member.

6. The personal illumination device of claim 1 further comprising an on/off switch.

7. A personal illumination device comprising:

a first illumination strip having a first outer surface and a first inner surface, the first outer surface having a plurality of light emitting diodes disposed thereon;

a second illumination strip having a second outer surface and a second inner surface, the second outer surface having a plurality of light emitting diodes disposed thereon;

a plurality of depressible buttons embedded on the first outer surface of the first illumination strip;

two shoulder straps each having a first end and a second end, wherein the first end is coupled to the first illumination strip and the second end is coupled to the second illumination strip with each of the two shoulder straps having an enhancement strip disposed on a visible surface;

two waist straps coupled to the second illumination strip, the two waist straps each having a terminal end with a singular clip attached thereto and each of the two waist straps having an enhancement strip on a visible surface;

an integrated complimentary clip on the first inner surface of the first illumination strip, the integrated complimentary clip being complimentary in shape to the singular clip attached to the two waist straps; and a power source operably connected to the plurality of light emitting diodes.

8. The personal illumination device of claim 7 further comprising strap adjustment mechanisms.

9. The personal illumination device of claim 8 wherein the strap adjustment mechanisms adjust the length of the shoulder straps and waist straps.

10. The personal illumination device of claim 9 wherein the first end of each of the two shoulder straps or the second end of each of the two shoulder straps is coupled by a looped fastener and pulled through the strap adjustment mechanism.

11. The personal illumination device of claim 9 wherein the terminal end of each of the two waist straps is coupled by a looped fastener and pulled through the strap adjustment mechanism.

12. The personal illumination device of claim 7 wherein the power source is at least one rechargeable or dry cell battery.

13. The personal illumination device of claim 7 wherein the enhancement strip is a reflective surface, lighted surface, high visibility colored surface, or any combination thereof.

* * * * *